US005735731A

United States Patent [19]

Lee

[11] Patent Number: 5,735,731

[45] Date of Patent: Apr. 7, 1998

[54] WAFER POLISHING DEVICE

[75] Inventor: Byoung-hun Lee, Kyungki-do, Rep. of Korea

[73] Assignee: Samsung Electronics Co., Ltd., Kyungki-do, Rep. of Korea

[21] Appl. No.: 606,194

[22] Filed: Feb. 23, 1996

[30] Foreign Application Priority Data

Aug. 7, 1995 [KR] Rep. of Korea ..... 95-24297

[51] Int. Cl.[6] ..... B24B 5/00

[52] U.S. Cl. ..... 451/143; 451/168; 451/53; 451/307; 451/388; 451/287; 451/288; 451/392; 451/41

[58] Field of Search ..... 451/287, 289, 451/292, 388, 53, 7, 307, 449, 41, 42, 36, 385, 290, 377, 394

[56] References Cited

U.S. PATENT DOCUMENTS

| | | | |
|---|---|---|---|
| 4,513,538 | 4/1985 | Wolters et al. | 451/290 |
| 4,597,228 | 7/1986 | Koyama et al. | 451/388 |
| 4,640,651 | 2/1987 | Runyon | 451/290 |
| 4,930,259 | 6/1990 | Kobylenski et al. | 451/307 |
| 5,127,196 | 7/1992 | Morimoto et al. | 451/53 |
| 5,476,413 | 12/1995 | Hasegawa et al. | 451/168 |
| 5,527,209 | 6/1996 | Volodarsky et al. | 451/388 |

FOREIGN PATENT DOCUMENTS

| | | | |
|---|---|---|---|
| 2709709 | 9/1978 | Germany | 451/41 |
| 361136762 | 6/1986 | Japan | 451/290 |
| 361142061 | 6/1986 | Japan | 451/290 |
| 363074563 | 4/1988 | Japan | 451/288 |
| 363251166 | 10/1988 | Japan | 451/288 |
| 33765 | 1/1991 | Japan | 451/287 |
| 404152059 | 5/1992 | Japan | 451/307 |
| 66160 | 5/1993 | Japan | 451/285 |

*Primary Examiner*—Robert A. Rose
*Assistant Examiner*—George Nguyen
*Attorney, Agent, or Firm*—Cushman Darby & Cushman IP Group of Pillsbury Madison & Sutro LP

[57] ABSTRACT

An improved chemical mechanical polishing (CMP) device for chemically and mechanically planarizing the surface of a semiconductor wafer includes a flat wafer stage for loading and affixation of the semiconductor wafer so that the surface of a material to be polished, i.e. the surface of the wafer, faces up, and a cylindrical polishing pad formed above the exposed surface of the wafer to be polished which is rotatable at high speed so that the contact point of the wafer and the pad moves linearly. The stage is constructed to support a wafer by a vacuum suction through vacuum holes. The cylindrical polishing pad has a rotating axis for transmitting rotation at the center, thereof, and a double layer polishing pad having different hardness on a peripheral surface of the rotating axis.

26 Claims, 2 Drawing Sheets

WAFER POLISHING DEVICE

BACKGROUND OF THE INVENTION

The present invention relates to a device for planarizing the surface of a semiconductor wafer, and more particularly to an improved chemical mechanical polishing (CMP) machine.

As the integration of integrated circuits increases and the use of multi-layer wiring processes becomes practical, global planarization of inter-level insulation layers becomes more important. Under these circumstances, CMP has been widely adopted as a preferred technique for planarization.

Generally a CMP machine polishes the surface of a wafer mechanically using a polishing pad and a slurry solution. This causes problems related to the clean-up of the slurry residue and the particles from the wafer surface. At first, the compatibility of such a dirty process with a clean room environment, was questionable and it was at first thought to be difficult to put the CMP machine to practical use. Since the CMP machine has good shape controllability in the vertical direction in contrast to conventional methods, however the practical use of the CMP machine has been highly anticipated. Accordingly, active research into CMP machines that can handle mass production has been conducted by semiconductor device manufacturers.

FIG. 1 is a section view of a conventional CMP machine. As shown in FIG. 1, the conventional CMP machine primarily consists of rotatable polishing platen 11 and linearly movable wafer carrier 19. Wafer 10 is affixed under wafer carrier 19 by retaining ring 17, positioned at the bottom of the wafer carrier. Polishing pad 13, which is adhered to the top surface of polishing platen 11, faces the surface of wafer 10 to be polished.

There are problems associated with the conventional CMP machine, having the aforesaid structure, in connection with its operation. Some of the problems are as follows: handling of the wafer is difficult because the surface of the wafer to be polished faces down, the slurry cannot be smoothly supplied to the center of wafer 10, it is difficult to control the process temperature, polishing platen 11 is too heavy to be suitable for a low dishing process which requires high speed rotation, and it is difficult to apply a small amount of pressure required to implement a low dishing process.

First, since the surface of a wafer to be polished faces down, it is very difficult to handle. The spacing between retaining rings 17, for preventing an escape of wafer 10, and pad 13 has to be adjusted to one third the thickness of wafer 10 to obtain the best result, but it is difficult to maintain this spacing. Also, wafers are often broken if the spacing is not appropriate. In addition, slurry 15 accumulates in flat-zone portions because there is a gap between the wafer backing film and the polishing pad. The non-uniform distribution of the slurry generates a flat-zone defect which polishes the flat-zone portion of the wafer first. Moreover, loading the wafer is a cumbersome task and the likelihood of it being scratched is high.

Second, since pad 13 is wholly in contact with the surface of wafer 10 to be polished, slurry 15 cannot be smoothly supplied to the center of the wafer. Accordingly, polishing uniformity deteriorates, and to correct this problem minute adjustments of the pressure distribution of wafer carrier 19 must be made. Because the whole surface of the wafer must make contact with the pad, it is difficult to adapt this type of polishing machine to large diameter wafer processes, i.e. to wafers with diameters that are 12" or larger.

Third, the conventional CMP machine has difficulties in controlling process temperature since it controls the temperature of the platen which is thermally isolated from the wafer by the polishing pad attached thereon.

Fourth, rotating the extremely heavy platen 11 of a conventional device makes it unsuitable for a low dishing process which requires high speed rotation. In other words, the conventional device becomes mechanically unstable in a polishing process requiring a high speed rotation over 200 rpm. Also, even at 150 rpm, the conventional device has problems such as the inability to supply the right amount of slurry and increased process temperature.

Fifth, application of a small amount of working pressure is required in order to implement a low dishing process, but it is difficult to decrease pressure to the minimum pressure required for improving polishing uniformity. It is also difficult to reduce the weight of wafer carrier 19 itself. Accordingly, when platen 11 rotates, it is nearly impossible to apply slight pressure uniformly to the whole surface of the wafer.

SUMMARY OF THE INVENTION

To solve the above problems, it is an object of the present invention to provide a new type of CMP machine.

Accordingly, to achieve the above object, there is provided a CMP machine according to the present invention for planarizing a semiconductor wafer by a chemical and mechanical method, the CMP machine comprising: a flat wafer stage for loading and affixation of the semiconductor wafer so that the surface of the material to be polished, i.e. the surface of the wafer, faces up; and a cylindrical polishing pad which is rotatable at high speed, formed above the exposed surface of the wafer to be polished so that a small gap exists between the pad and wafer. The pad overlies the wafer moves along a line.

Preferably, the wafer stage of the present invention for loading the semiconductor wafer by a horizontal loading method and supporting the loaded wafer is constructed to have a large number of vacuum holes to support the wafer by vacuum suction through the holes, has a deionized (DI) water rinse function and/or an air blowing function so that the stage can be rinsed and/or blown periodically to prevent the contamination of the inside of the vacuum line by the polishing agent, and is formed of a porous ceramic to prevent metal contamination.

Preferably, the cylindrical polishing pad of the present invention has a rotating axis for transmitting rotation at the center, thereof, and a double layer polishing pad comprised of two layers having different hardnesses at the peripheral surface of the rotating axis. The outer layer of the double layer polishing pad is formed of a material that is harder than the inner layer, thereof, so that a flat polishing operation can be performed during contact with the part of the surface of the wafer to be polished. The inner layer of the double layer polishing pad supports the outer layer, thereof, serving as a buffer, and is formed of such a soft material that polishing uniformity is improved by adjusting the contact area of the outer layer and the wafer.

In addition, according to the present invention, there is also provided a flat table which can perform linear motion and/or rotation in the lower portion of the wafer stage, thus uniformly polishing the whole surface of the wafer by rotating the pad, moving the table linearly and/or rotating the table. There is also a cooling means between the wafer stage and the table enabling direct control of the temperature of the wafer.

According to a preferred embodiment of the present invention, a wafer is loaded horizontally in such a manner that the surface of the wafer to be polished faces up and the wafer is affixed to a stage having a vacuum suction function and an optional rinse function. The polishing process is performed by a rotation of a cylindrical polishing pad with only part of the surface of the wafer to be polished in contact with the pad, thus improving polishing uniformity and flatness and facilitating wafer handling.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 2:
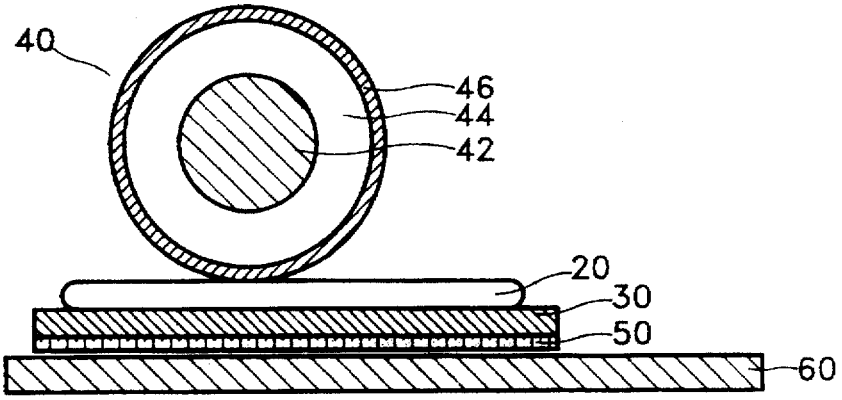
FIG. 2 is a section view of a CMP machine according to the present invention.
Figure 3:
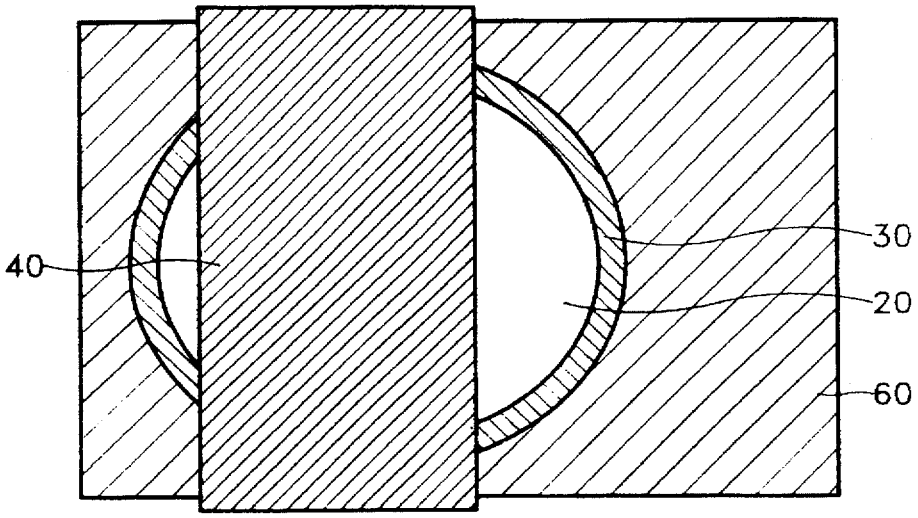
FIG. 3 is an extracted plan view of the CMP shown in FIG. 2.

As shown in FIGS. 2 and 3, wafer 20 is placed on the upper surface of in order flat wafer stage 30 in order to expose the surface of a material to be polished, i.e., the surface of the wafer, and wafer 20 is loaded/unloaded on stage 30 by a horizontal loading method. Cylindrical polishing pad 40 is formed above the exposed surface of wafer 20, to be polished, so that a small gap exists between pad 40 and wafer 20. Pad 40 is rotatable at high speed and overlies wafer 20 along a line.

The hardness of polishing pad 40 is very important considering that uniformity and flatness of the polishing determine the effectiveness of the CMP process. For example, if a hard polishing pad is used, flatness improves, but uniformity worsens. On the other hand, if a soft polishing pad is used, uniformity improves, but flatness worsens creating a slope in the polished surface. Accordingly, polishing pad 40 of the present invention has rotating axis 42 for transmitting rotation at the center thereof, and a double layer polishing pad comprised of two layers having different hardnesses on a peripheral surface of rotating axis 42.

As shown in FIG. 2, outer layer 46 of the double layer polishing pad is formed of a material which is harder than inner layer 44, thereof, to perform a flat polishing operation by making contact to part of the surface of wafer 20. Also, inner layer 44 of the double layer polishing pad supports outer layer 46, thereof, and serves as a buffer layer. Inner layer 44 is formed of a material which is softer than outer layer 46 so that polishing uniformity is improved due to the adjustability of the contact area by the outer layer 46 to wafer 20.

Cooling unit 50 is provided under wafer stage 30 for temperature adjustment of wafer stage 30 enabling direct control of the temperature of wafer 20.

Also, to improve polishing characteristics, flat table 60 which can perform linear and/or rotational movement under wafer stage 30 may also be provided, thus uniformly polishing the whole surface of wafer 20 by a linear and/or a rotational movement of table 60, and rotation of cylindrical polishing pad 40.

Figure 4A:
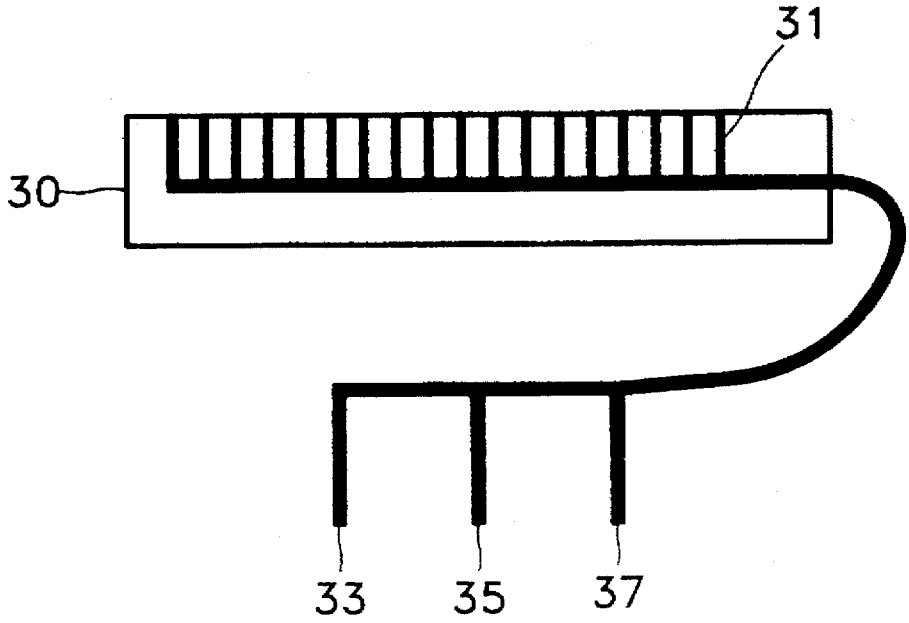
FIG. 4A is an enlarged view of a wafer stage of a polishing device according to the present invention.
Figure 4B:
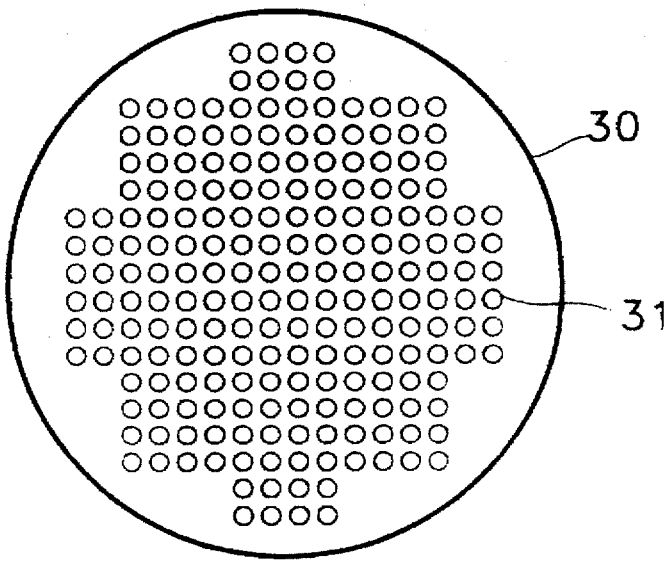
FIG. 4B is a plan view of a wafer stage of a polishing device shown in FIG. 4A.

FIG. 4A is an enlarged section view showing wafer stage 30 of a CMP machine having the aforesaid structure. FIG. 4B is an enlarged view showing the planar structure of wafer stage 30. As shown in FIGS. 4A and 4B wafer stage 30 for loading semiconductor wafer 20 by a horizontal loading method and supporting the loaded wafer is constructed to have a large number of vacuum holes 31 throughout the whole surface of the stage and for affixation of the wafer by a vacuum suction method through vacuum holes 31.

It is very important to clean the wafer stage, because the inside of the wafer stage may be contaminated by the use of a polishing agent. In the present invention, wafer stage 30 has a simple rinse function for preventing the contamination of the inside of the device due to the polishing agent. In other words, in-line vacuum device 33 for vacuum suction, and deionized (DI) water rinse device 35 and/or air blowing device 37 are provided to periodically rinse and/or blow slurry particles off wafer stage 30 where wafer 20 is placed, thus improving the rinse function. Wafer stage 30 is preferably formed of a porous ceramic to prevent metal contamination.

The advantages of a CMP machine according to the present invention, having the aforementioned structure, over the prior art will now be described.

Figure 1:
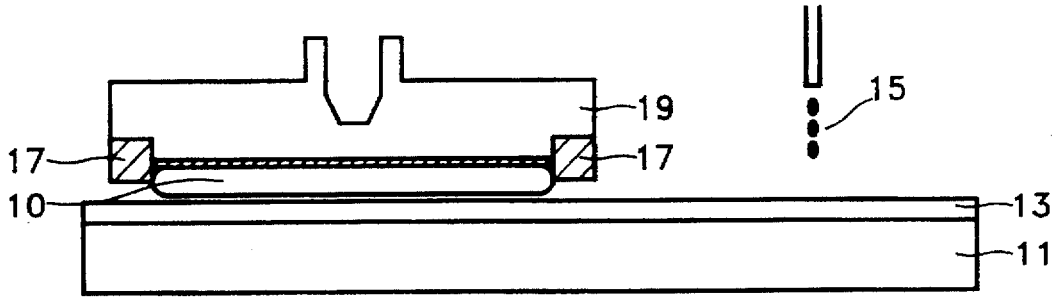
FIG.1(PRIOR ART)
FIG. 1 is a section view of a conventional CMP machine.

The problem generated during wafer handling in the conventional device can be solved by the horizontal loading method. In other words, the horizontal loading method facilitates loading/unloading. Also, in contrast to the conventional device, wafer breakage due to the retaining rings (17 in FIG. 1) are avoided since they are not employed in the present invention. Instead, the present invention adopts a wafer stage using a vacuum sucking method (FIG. 4) to hold the wafer.

The present invention allows for very easy control of the process temperature, because the temperature of wafer 20 can be directly controlled by cooling unit 50 adhering to wafer stage 30, while in the case of the conventional method temperature control is restricted by its structure.

Cylindrical pad 40 of the present invention has the following advantages as compared with conventional pad 13 which makes contact to the whole surface of a wafer.

- Cylindrical pad 40 rotates much faster than a polishing platen 11 where conventional pad 13 is fixed. Thus, even though pad 40 does not make contact with the whole surface of a wafer, a sufficient polishing rate is obtained and dishing is reduced due to the high speed rotation.
- The contact area of the pad and the surface of the wafer to be polished can be varied by adjusting the hardness of soft inner layer 44 supporting hard outer layer 46. Thus, characteristics such as a polishing rate can be adjusted depending on process conditions.
- The device of the present invention facilitates controlling flatness and uniformity because the overlies of the wafer and along a line.

As for the problem of controlling polishing pressure using the conventional device, since polishing pressure can be controlled to be very small by adjusting height of the cylindrical pad 40 or the hardness of inner layer 44 of cylindrical pad 40, it is possible to improve the flatness characteristic of the polishing. Also, unlike the conventional device, a polishing pressure can be controlled to be very small without a separate device for reducing the weight of wafer carrier 19 itself.

Unlike the conventional device, since slurry cannot accumulate anywhere, a flat zone defect is not generated.

The CMP machine of the present invention is easy to manufacture in comparison to the conventional device. Also, automation and miniaturization are possible in addition to having the capability to easily handle a large diametrical wafer.

As described above, according to a CMP machine of the present invention, a wafer is loaded by a horizontal loading method so that the surface of the wafer to be polished faces up, the wafer is affixed to a stage having a vacuum suction and/or rinse function, and a polishing process is performed by a rotation of a cylindrical polishing pad in which only part of the surface of the wafer to be polished is in contact with the pad, thus facilitating wafer handling and manufacturing of the device. All this enables automation and miniaturization while improving the polishing uniformity and flatness.

What is claimed is:

1. A chemical mechanical polishing (CMP) machine for planarizing a semiconductor wafer, said CMP machine comprising:

a flat wafer stage for loading and affixation of said semiconductor wafer so that an exposed surface of said wafer to be polished faces up; and a cylindrical polishing pad formed above and spaced slightly apart from the exposed surface of said wafer to be polished, said cylindrical polishing pad being rotatable and positionable to contact said wafer along a line across the exposed surface of said wafer;

wherein said cylindrical polishing pad has a rotating axis for transmitting rotation and a double layer polishing pad on a peripheral surface of said rotating axis, said double layer polishing pad being comprised of two layers having different hardnesses; and wherein an outer layer of said double layer polishing pad, which performs a polishing operation by contacting with part of the surface of said wafer to be polished is formed of a material which is harder than an inner layer, thereof, for improving flattening characteristics.

2. A CMP machine according to claim 1, further comprising a flat table linearly movable or rotatable under said wafer stage, thus allowing uniform polishing of the whole exposed surface of the wafer by a rotation of said pad, and a linear motion or a rotation of said table.

3. A CMP machine according to claim 1, further comprising a cooling unit provided adjacent said wafer stage for controlling the temperature of said wafer.

4. A CMP machine according to claim 1, further comprising a cooling means provided between said wafer stage and said table for directly controlling the temperature of said wafer.

5. A CMP machine according to claim 1, further comprising a flat table linearly movable and rotatable under said wafer stage, thus allowing uniform polishing of the whole exposed surface of the wafer by a rotation of said pad, and a linear motion and a rotation of said table.

6. A chemical mechanical polishing (CMP) machine for planarizing a semiconductor wafer, said CMP machine comprising:

a flat wafer stage for loading and affixation of said semiconductor wafer so that an exposed surface of said wafer to be polished faces up; and a cylindrical polishing pad formed above and spaced slightly apart from the exposed surface of said wafer to be polished, said cylindrical polishing pad being rotatable and positionable to contact said wafer along a line across the exposed surface of said wafer;

wherein said cylindrical polishing pad has a rotating axis for transmitting rotation and a double layer polishing pad on a peripheral surface of said rotating axis, said double layer polishing pad being comprised of two layers having different hardnesses; and wherein said inner layer of said double layer polishing pad supports said outer layer thereof and is formed of a material which increases the polishing uniformity via a larger contact area of said outer layer and said exposed surface of said wafer along said line.

7. A CMP machine according to claim 6, further comprising a flat table linearly movable or rotatable under said wafer stage, thus allowing uniform polishing of the whole exposed surface of the wafer by a rotation of said pad, and a linear motion or a rotation of said table.

8. A CMP machine according to claim 6, further comprising a cooling unit provided adjacent said wafer stage for controlling the temperature of said wafer.

9. A CMP machine according to claim 6, further comprising a cooling means provided between said wafer stage and said table for directly controlling the temperature of said wafer.

10. A CMP machine according to claim 6, further comprising a flat table linearly movable and rotatable under said wafer stage, thus allowing uniform polishing of the whole exposed surface of the wafer by a rotation of said pad, and a linear motion and a rotation of said table.

11. A chemical mechanical polishing (CMP) machine for planarizing a semiconductor wafer, said CMP machine comprising:

a flat wafer stage for loading said semiconductor wafer by a horizontal loading method so that an exposed surface of said wafer to be polished faces up, said flat wafer stage having a large number of vacuum holes for affixation of the loaded wafer by a vacuum suction; and a cylindrical polishing pad formed above and spaced slightly apart from the exposed surface of said wafer, said cylindrical polishing pad being rotatable and positionable to contact said wafer along a line across the exposed surface of said wafer;

wherein said cylindrical polishing pad has a rotating axis for transmitting rotation and a double layer polishing pad on a peripheral surface of said rotating axis, said double layer polishing pad being comprised of two layers having different hardnesses; and wherein an outer layer of said double layer polishing pad, which performs a polishing operation by contacting with part of the surface of said wafer to be polished is formed of a material which is harder than an inner layer, thereof, for improving flattening characteristics.

12. A CMP machine according to claim 11, wherein said wafer stage is connectable to receive a deionized (DI) water rinse to prevent the contamination of the inside of said machine.

13. A CMP machine according to claim 11, wherein said wafer stage is connectable to receive air to prevent the contamination of the inside of said machine.

14. A CMP machine according to claim 11, wherein said wafer stage comprises porous ceramic to prevent metal contamination.

15. A CMP machine according to claim 11, further comprising a flat table linearly movable or rotatable under said wafer stage, thus allowing uniform polishing of the whole exposed surface of the wafer by a rotation of said pad, and a linear motion or a rotation of said table.

16. A CMP machine according to claim 11, further comprising a cooling unit provided adjacent said wafer stage for controlling the temperature of said wafer.

17. A CMP machine according to claim 11, further comprising a cooling means provided between said wafer stage and said table for directly controlling the temperature of said wafer.

18. A CMP machine according to claim 11, further comprising a flat table linearly movable and rotatable under said wafer stage, thus allowing uniform polishing of the whole exposed surface of the wafer by a rotation of said pad, and a linear motion and a rotation of said table.

19. A chemical mechanical polishing (CMP) machine for planarizing a semiconductor wafer, said CMP machine comprising:

a flat wafer stage for loading said semiconductor wafer by a horizontal loading method so that an exposed surface of said wafer to be polished faces up, said flat wafer stage having a large number of vacuum holes for affixation of the loaded wafer by a vacuum suction; and a cylindrical polishing pad formed above and spaced slightly apart from the exposed surface of said wafer, said cylindrical polishing pad being rotatable and positionable to contact said wafer along a line across the exposed surface of said wafer; and wherein said cylindrical polishing pad has a rotating axis for transmitting rotation and a double layer polishing pad on a peripheral surface of said rotating axis, said double layer polishing pad being comprised of two layers having different hardnesses;

wherein said inner layer of said double layer polishing pad supports said outer layer thereof and is formed of a material which increases the polishing uniformity via a larger contact area of said outer layer and said exposed surface of said wafer along said line.

20. A CMP machine according to claim 19, wherein said wafer stage is connectable to receive a deionized (DI) water rinse to prevent the contamination of the inside of said machine.

21. A CMP machine according to claim 19, wherein said wafer stage is connectable to receive air to prevent the contamination of the inside of said machine.

22. A CMP machine according to claim 19, wherein said wafer stage comprises porous ceramic to prevent metal contamination.

23. A CMP machine according to claim 19, further comprising a flat table linearly movable or rotatable under said wafer stage, thus allowing uniform polishing of the whole exposed surface of the wafer by a rotation of said pad, and a linear motion or a rotation of said table.

24. A CMP machine according to claim 19, further comprising a cooling unit provided adjacent said wafer stage for controlling the temperature of said wafer.

25. A CMP machine according to claim 19, further comprising a cooling means provided between said wafer stage and said table for directly controlling the temperature of said wafer.

26. A CMP machine according to claim 19, further comprising a flat table linearly movable and rotatable under said wafer stage, thus allowing uniform polishing of the whole exposed surface of the wafer by a rotation of said pad, and a linear motion and a rotation of said table.

* * * * *